US005775225A

United States Patent [19]

Saitou

[11] Patent Number: 5,775,225

[45] Date of Patent: Jul. 7, 1998

[54] PLATE CYLINDER HAVING GLASS BEADS THEREON FOR A SHEET-FED PRINTING PRESS

[75] Inventor: Shigetoshi Saitou, Shizuoka, Japan

[73] Assignee: Shinohara Machinery Co., Ltd., Shizuoka-ken, Japan

[21] Appl. No.: 829,934

[22] Filed: Apr. 1, 1997

[51] Int. Cl.[6] ..... B41F 13/16; B41F 27/12

[52] U.S. Cl. ..... 101/415.1; 101/378

[58] Field of Search ..... 101/415.1, 420, 101/378

[56] References Cited

U.S. PATENT DOCUMENTS

| | | | |
|---|---|---|---|
| 2,555,319 | 6/1951 | Cross | 101/420 |
| 2,804,417 | 8/1957 | Cross et al. | 101/420 |
| 4,688,784 | 8/1987 | Wirz | 101/348 |
| 5,042,383 | 8/1991 | Wirz | 101/420 |
| 5,361,697 | 11/1994 | Stellberger | 101/378 |
| 5,461,981 | 10/1995 | Schneider | 101/415.1 |

FOREIGN PATENT DOCUMENTS

| | | |
|---|---|---|
| 8-18423 | 2/1996 | Japan . |

*Primary Examiner*—Edgar S. Burr
*Assistant Examiner*—Leslie Grohusky
*Attorney, Agent, or Firm*—Ladas & Parry

[57] ABSTRACT

Plate cylinder of sheet-fed printing press is disclosed whose circumference is covered by minute glass beads 14 of approximately uniform diameters in order to decrease a friction force between a plate as well as to prevent the generation of static electricity.

13 Claims, 1 Drawing Sheet

PLATE CYLINDER HAVING GLASS BEADS THEREON FOR A SHEET-FED PRINTING PRESS

FIELD OF THE INVENTION

The present invention relates to a sheet-fed printing press and, more particularly, to a structure of plate cylinder to which a plate is attached.

DESCRIPTION OF THE PRIOR ART

In a sheet-fed printing press for printing on sheets,various kinds of plates such as a presensitized plate made of aluminum board or a paper plate made of water-resistant paper are wound around the circumference of the plate cylinder. In order to obtain good printing quality, register adjustment is needed to correct the slight deviation of register by adjusting the position of the plate cylinder itself or the plate.

Especially, in a so-called plate-cocking which slightly adjusts the wound plate in relation to the plate cylinder as shown in the Japanese patent laid-open No. 77398/1993, it is indispensable that the plate can freely move and slide in relation to the surface of the plate cylinder. Plate-cocking will be hindered if the plate is tightly attracted to the surface of the cylinder, producing friction force and static electricity. In other words, plate-cocking is impossible if the plate is adhered onto the surface of the cylinder by friction force and static electricity.

Especially, in the case of a non-water plate, as dampening water is not provided on the plate, influence of friction force and generation of static electricity are extreme. Accordingly, the non-water plate adheres onto the surface of the plate cylinder to invalidate the plate-cocking which requires the free sliding of the plate.

In Japanese published patent No. 18423/1996, a plate cylinder is disclosed in which the roughness of the surface is purposely adjusted by grinding. But, the friction force between the plate is rather increased by this technique.

SUMMARY OF THE INVENTION

In view of the above-described problems, it is an object of the present invention to provide an improved plate cylinder of sheet-fed press by which the friction force between the plate and generation of static electricity are drastically decreased. To attain this object, a plate cylinder according to the present invention has on its circumference a surface to which minute glass beads of uniform diameter are gathered.

The minute glass beads drastically decrease the friction force with the plate and prevent the generation of the static electricity.

The above and other objects and features of the present invention will become apparent from the following description of the preferred embodiment thereof, taken in conjunction with the accompanying drawings. However, it should be noted that the following embodiment is merely an example, and the present invention is not limited thereto.

DESCRIPTION OF THE PREFERRED EMBODIMENT

Figure 1:
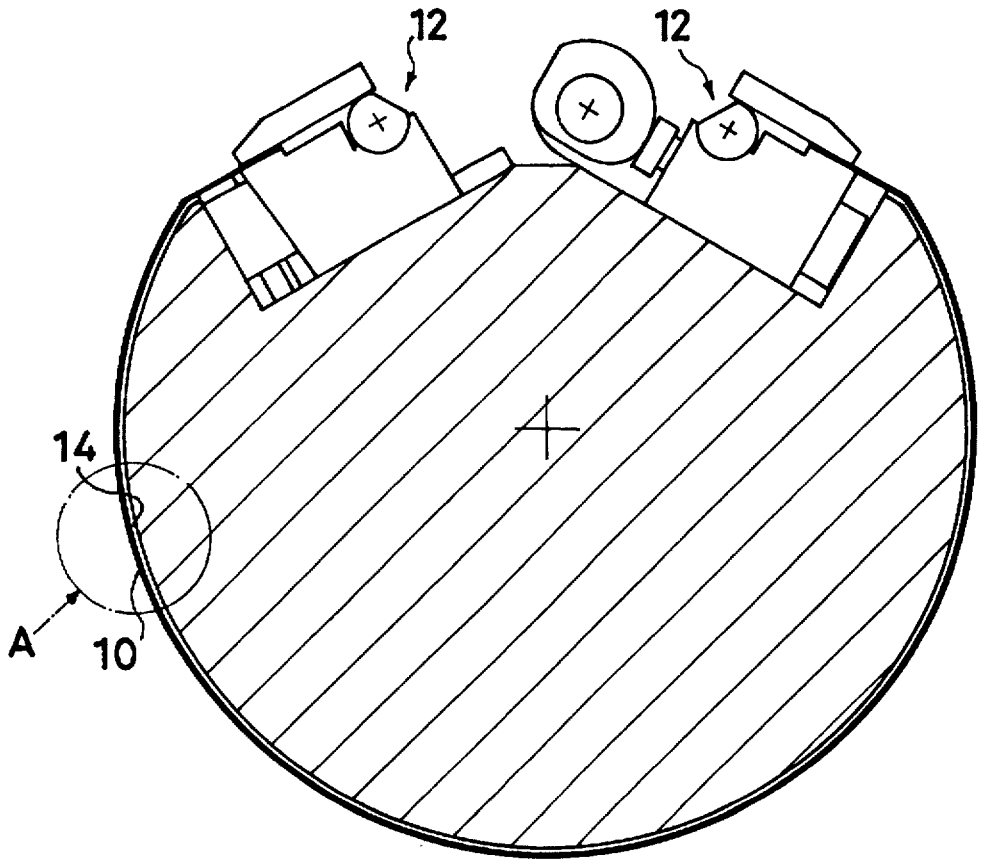
FIG. 1 is a conceptual sectional view of the plate cylinder according to the present invention.

The printing cylinders for sheet-fed printing press comprise plate cylinder, blanket cylinder, press cylinder and so on, but only the plate cylinder is shown in FIG. 1. On the outer surface of the plate cylinder, there exists the circumference to which a plate 10 is attached and wound as well as a hollow portion for storing a plate clamping device 12 which grips and stretches the plate 10. It is well known by, for example Japanese patent laid-open No. 77398/1993 that the plate-cocking is effected by freely sliding the plate 10 in relation to the circumference of plate cylinder by means of plate clamping device 12.

Figure 2:
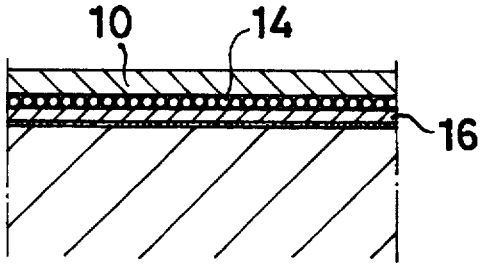
FIG. 2 is an enlarged sectional view of a portion of FIG. 1.

As shown in the enlarged sectional view of FIG. 2, minute glass beads 14 of about 3/100 mm to 4/100 mm are densely provided on the circumference of the plate cylinder according to the present invention. Namely, minute glass beads 14 are densely gathered and adhered onto the base film 16 of polyester film and the base film 16 is adhered onto the circumference of the cylinder.

The techniques for manufacturing the minute glass beads 14 of uniform diameter and densely providing and adhering them onto the base film 16 are already established. The feature of the present invention lies in that the minute glass beads 14 are attached onto the plate cylinder by adhering the base film 16 with glass beads 14 onto the plate cylinder.

The minute glass beads 14 drastically decrease the sliding friction resistance with the plate 10 and prevent the generation of static electricity. Thereby, free sliding of plate 10 is ensured and plate-cocking can smoothly be effected.

It should be noted that the present invention is not limited to the embodiment described above and that various changes and modifications may be imparted thereto.

What is claimed is:

1. In a plate cylinder for a sheet-fed printing press comprising a cylinder and a printing plate that is releasably clamped onto a surface of the cylinder, the improvement comprising glass bead means, comprising glass beads of approximately uniform diameter on the surface of the cylinder between the cylinder and the plate, said glass beads projecting from the surface of the cylinder with substantially an entire diameter of the beads projecting for contact with a printing plate for facilitating slidable movement of the printing plate along the surface of the cylinder.

2. A plate cylinder as claimed in claim 1, wherein the glass bead means comprises a base film to which the glass beads adhere, said base film adhering to the surface of the cylinder.

3. A plate cylinder as claimed in claim 2, wherein the glass beads are densely gathered on the base film.

4. A plate cylinder as claimed in claim 2, wherein the glass beads are densely gathered on the base film and have a diameter of between about 3/100 mm to 4/100 mm.

5. A plate cylinder as claimed in claim 3 wherein the base film is a polyester film.

6. A plate cylinder to which a printing plate of a sheet-fed printing press can be releasably clamped, said plate cylinder comprising a surface and a hollow portion for storing plate clamping means for gripping and stretching the printing plate along the surface of the plate cylinder, said surface being provided with glass beads of approximately uniform diameter, said glass beads being provided on and projecting from said surface with substantially an entire diameter of the beads available for contact with the plate, said beads having a size and density that permits the printing plate to slide freely along the surface substantially without generation of static electricity.

7. A plate cylinder as claimed in claim 6 including plate clamping means.

8. A plate cylinder as claimed in claim 7, wherein the surface comprises a base film to which the glass beads adhere.

9. A plate cylinder as claimed in claim 8, wherein the glass beads are densely gathered on the base film and have a diameter of between about 2/100 mm to 4/100 mm.

10. A plate cylinder as claimed in claim 8, wherein the base film is a polyester film.

11. A plate cylinder to which a printing plate of a sheet-fed printing press can be releasably clamped, said plate cylinder having a surface comprising a base film, said base film having adhered thereto glass beads of approximately uniform diameter, said glass beads projecting from the base film with substantially an entire diameter of the beads projecting for contact with the plate, said glass beads being provided on said surface in a size and density that permits the printing plate to slide freely along the surface substantially without generation of static electricity.

12. A plate cylinder as claimed in claim 11, wherein the glass beads are densely gathered on the base film and have a diameter of between about 2/100 mm to 4/100 mm.

13. A plate cylinder as claimed in claim 12 wherein the plate cylinder further comprises plate clamping means for gripping and stretching the printing plate along the surface of the plate cylinder.

* * * * *